US009394918B2

(12) United States Patent
Lin et al.

(10) Patent No.: US 9,394,918 B2
(45) Date of Patent: Jul. 19, 2016

(54) FAN STRUCTURE WITH EASY ASSEMBLY

(71) Applicant: Wistron Corporation, New Taipei (TW)

(72) Inventors: Chun-Cheng Lin, New Taipei (TW); Li Liu, New Taipei (TW)

(73) Assignee: Wistron Corporation, Hsichih, New Taipei (TW)

( * ) Notice: Subject to any disclaimer, the term of this patent is extended or adjusted under 35 U.S.C. 154(b) by 587 days.

(21) Appl. No.: 13/922,269

(22) Filed: Jun. 20, 2013

(65) Prior Publication Data

US 2014/0072406 A1 Mar. 13, 2014

(30) Foreign Application Priority Data

Sep. 7, 2012 (CN) ..... 2012 1 0331471

(51) Int. Cl.
*F04D 29/64* (2006.01)
*F04D 29/66* (2006.01)
*F04D 29/60* (2006.01)

(52) U.S. Cl.
CPC ..... *F04D 29/646* (2013.01); *F04D 29/601* (2013.01); *F04D 29/668* (2013.01)

(58) Field of Classification Search
CPC ..... F04D 29/646; F04D 29/644; F04D 29/64; F04D 29/60; F04D 29/601; F04D 19/02
See application file for complete search history.

(56) References Cited

U.S. PATENT DOCUMENTS

| | | | | |
|---|---|---|---|---|
| 8,348,607 | B2 | 1/2013 | Liu | |
| 2009/0021911 | A1 | 1/2009 | Lee | |
| 2012/0163971 | A1* | 6/2012 | Chiu | F04D 29/601 415/213.1 |

FOREIGN PATENT DOCUMENTS

| | | | | |
|---|---|---|---|---|
| CN | 2480899 | Y | 3/2002 | |
| CN | 200949569 | Y | 9/2007 | |
| CN | 201092980 | Y | 7/2008 | |
| TW | M304710 | | 1/2007 | |
| TW | M310577 | | 4/2007 | |
| TW | 201034554 | | 9/2010 | |
| TW | 407595 | U * | 7/2011 | H05K 7/20 |
| TW | M407595 | | 7/2011 | |

OTHER PUBLICATIONS

Office action mailed on Nov. 3, 2014 for the Taiwan application No. 101134060, filing date: Sep. 17, 2012, p. 2 line 7-26, p. 3-5 and p. 6 line 1-4.

Office action mailed on Apr. 18, 2016 for the China application No. 201210331471.1, p. 3 line 4-30, p. 4-6 and p. 7 line 1-6.

* cited by examiner

*Primary Examiner* — Richard Edgar
(74) *Attorney, Agent, or Firm* — Winston Hsu; Scott Margo

(57) ABSTRACT

A fan structure includes at least one installation standoff, a fan and a fixing frame. An end of the at least one installation standoff is installed on a substrate, and a positioning slot is formed on the other end of the at least one installation standoff. The fixing frame is installed on the fan and includes at least one positioning hook for engaging with the positioning slot of the at least one installation standoff, so as to fix the fixing frame on the substrate. A guiding slot is formed on at least one side of the fixing frame for guiding the at least one installation standoff to move on the fixing frame. The fixing frame further includes at least one resilient portion connected to the at least one positioning hook for driving the at least one positioning hook to separate from the at least one positioning slot.

18 Claims, 7 Drawing Sheets

FAN STRUCTURE WITH EASY ASSEMBLY

BACKGROUND OF THE INVENTION

1. Field of the Invention

The present invention relates to a fan structure, and more specifically, to a fan structure with easy assembly.

2. Description of the Prior Art

For conventional electronic devices, such as a personal computer, a server computer and so on, a fan structure for dissipating heat is an essential component. Generally speaking, the fan is screwed and lies on a motherboard of the computer, so that it does not facilitate users to detach the fan structure from the electronic device. Moreover, the conventional electronic device is designed to be slim and light, so that a casing of the conventional electronic device becomes smaller and smaller. However, it is also desired to dispose more electronic components in the smaller casing at the same time, so less mechanical space is reserved for disposing the fan structure. As a result, it is an important issue to design a fan structure which is installed in a limited space and can be easily assembled and disassembled without any screw.

SUMMARY OF THE INVENTION

The present invention is to provide a fan structure with easy assembly to solve above problems.

According to the disclosure, a fan structure includes at least one installation standoff, a fan and a fixing frame. An end of the at least one installation standoff is installed on a substrate, and a positioning slot is formed on the other end of the at least one installation standoff; the fixing frame is installed on the fan, and the fixing frame includes at least one positioning hook for engaging with the positioning slot of the at least one installation standoff, so as to fix the fixing frame on the substrate.

According to the disclosure, the fan structure further includes a fixing standoff, an end of the fixing standoff is installed on the substrate, and the other end of the fixing standoff is plugged into a hole of the fixing frame, so as to fix the fixing frame on the substrate with the at least one installation standoff cooperatively.

According to the disclosure, the fan structure further includes a plurality of fastening components passing through the substrate and being fixed on the end of the at least one installation standoff and the end of the fixing standoff respectively, so as to fasten the at least one installation standoff and the fixing standoff on the substrate.

According to the disclosure, each fastening component is a screw.

According to the disclosure, a guiding slot is formed on at least one side of the fixing frame for guiding the at least one installation standoff to move on the fixing frame.

According to the disclosure, the fixing frame further comprises at least one resilient portion connected to the at least one positioning hook, and the at least one resilient portion drives the at least one positioning hook to separate from the at least one positioning slot as being pressed to move inwardly.

According to the disclosure, a guiding structure is formed on the end of the at least one installation standoff, and the guiding structure is for guiding the positioning slot of the at least one installation standoff to engage with the at least one positioning hook.

According to the disclosure, the fan comprises a connector, a connector socket corresponding to the connector is disposed on the substrate, and the connector is plugged into the connector socket simultaneously as the fixing frame is engaged with the at least one installation standoff.

According to the disclosure, a protruding structure is formed on the end of the at least one installation standoff, and the protruding structure is for contacting against the fixing frame as the fixing frame is engaged with the at least one installation standoff, so as to locate the fan relative to the substrate at a predetermined height.

According to the disclosure, the fan structure further includes at least one shock-absorbing component for fixing the fixing frame on the fan and further for absorbing relative vibration between the fixing frame and the fan.

According to the disclosure, an electronic device includes a casing, a substrate and a fan structure. The substrate is installed inside the casing; the fan structure includes at least one installation standoff, a fan and a fixing frame. An end of the at least one installation standoff is installed on the substrate, and a positioning slot is formed on the other end of the at least one installation standoff; the fixing frame is installed on the fan, and the fixing frame includes at least one positioning hook for engaging with the positioning slot of the at least one installation standoff, so as to fix the fixing frame on the substrate.

The fan structure of the present invention utilizes a fixing mechanism of the installation standoffs installed on the substrate and the positioning hooks of the fixing frame on the fan to easily engage the fixing frame with the installation standoffs, so as to achieve a purpose of fixing the fan on the substrate stably without any screw. In addition, users only need to press the resilient portion to detach the positioning hook from the installation standoff to achieve a purpose of easily detaching the fan from the substrate. Therefore, the present invention solves the problem that the installation space of the electronic device is too small to install the fan in the prior art.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
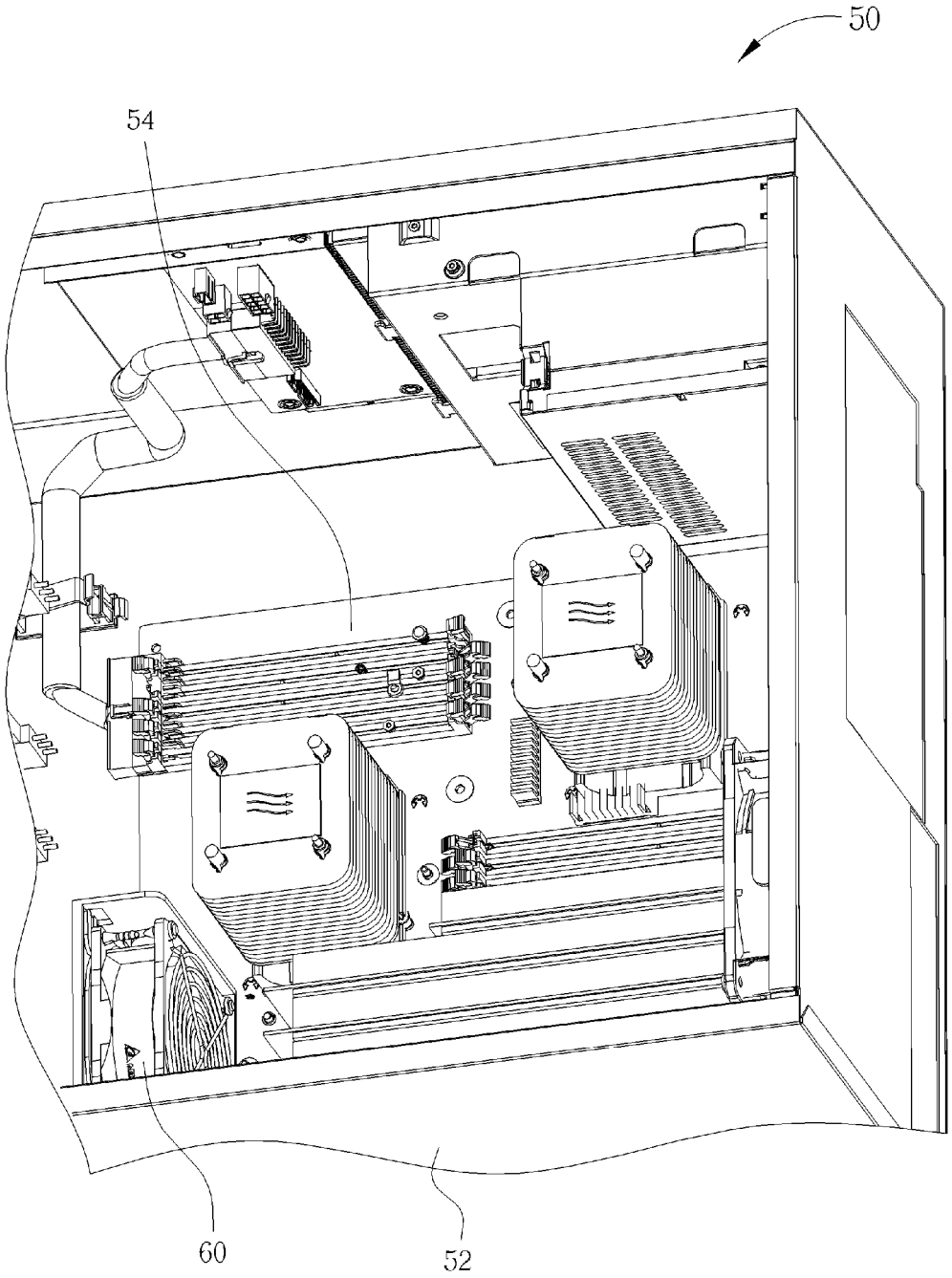
FIG. 1 is an internal diagram of an electronic device according to an embodiment of the present invention.
Figure 2:
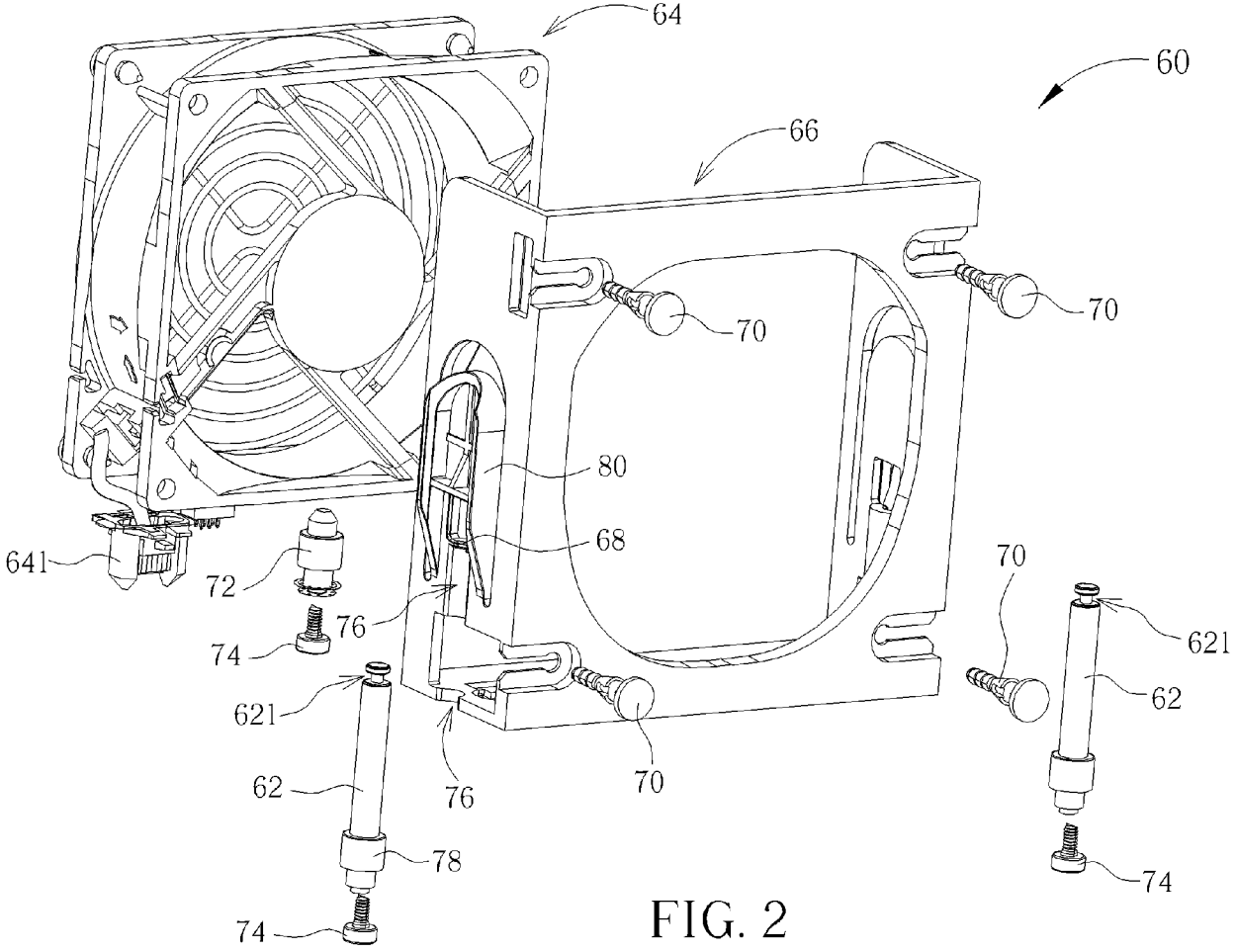
FIG. 2 is an exploded diagram of a fan structure according to the embodiment of the present invention.

Please refer to FIG. 1. FIG. 1 is an internal diagram of an electronic device 50 according to an embodiment of the present invention. The electronic device 50 can be a desktop computer, a business server computer and so on. The electronic device 50 includes a casing 52, a substrate 54 and a fan structure 60. The casing 52 can cover various kinds of electronic components, such as a CPU, a RAM, a hard drive, an interface card and so on. In this embodiment, the substrate 54 can be a motherboard, and the electronic components described above can be installed on the substrate 54, but the substrate 54 is not limited to the motherboard. The fan structure 60 can be installed on the substrate 54 for generating air convection to dissipate heat generated by the electronic components on the substrate 54 outside the electronic device 50, so as to maintain an operation temperature of each electronic component within an allowable working temperature. Please refer to FIG. 1 and FIG. 2. FIG. 2 is an exploded diagram of the fan structure 60 according to the embodiment of the present invention. The fan structure 60 includes at least one installation standoff 62, a fan 64 and a fixing frame 66. In this embodiment, the fan structure 60 includes two installation standoffs 62. Amounts and disposal of the installation standoff 62 are not limited to this embodiment, and it depends on actual design demand. An end of each installation standoff 62 is installed on the substrate 54, and a positioning slot 621 is formed on the other end of each installation standoff 62. The fan 64 includes a connector 641 electrically connected to the substrate 54, so as to receive electricity transmitted from the substrate 54 to enable the fan 64 to work normally. The fixing frame 66 is installed on the fan 64. The fixing frame 66 includes at least one positioning hook 68 for engaging with the positioning slot 621 of the corresponding installation standoff 62, so as to fix the fixing frame 66 on the substrate 54. In this embodiment, the fixing frame 66 includes two positioning hooks 68 disposed at two sides of the fixing frame 66 for engaging with the two positioning slots 621, respectively.

In addition, because capacity of a hard drive is growing, a rotating speed of the hard drive gets faster, and a read/write head of the hard drive gets smaller, excessive vibration may affect accuracy of reading/writing data by the read/write head of the hard drive. Even the read/write head may scratch discs of the hard drive due to the vibration, resulting in loss of information. In order to prevent the situation described above, the fan structure 60 of the present invention can be designed with a damping mechanism. The fan structure 60 can further include a shock-absorbing component 70 for fixing the fixing frame 66 on the fan 64 and further for absorbing relative vibration between the fixing frame 66 and the fan 64. That is, the shock-absorbing component 70 can absorb the vibration transmitted from the fan 64 to the fixing frame 66 as the fan 64 rotates, so that the vibration does not affect normal operation of the electronic components, such as the hard drive. In this embodiment, the fan structure 60 can include four shock-absorbing components 70 installed on four corners of the fixing frame 66 and the fan 64 respectively. Amounts and positions of the shock-absorbing components 70 are not limited to this embodiment, and it depends on actual design demand. The shock-absorbing component 70 can be made of rubber material with damping effect, so as to absorb the vibration generated by the fan 64 as the fan 64 rotates.

Furthermore, if it is designed to utilize the larger fan 64 and the fixing frame 66, the fan structure 60 can selectively include a fixing standoff 72 for stably fixing the fixing frame 66 on the substrate 54. An end of the fixing standoff 72 is installed on the substrate 54, and the other end of the fixing standoff 72 is plugged into the fixing frame 66, so as to fix the fixing frame 66 on the substrate 54 with the at least one installation standoff 62 cooperatively. In addition, the fan structure 60 further includes a plurality of fastening components 74 passing through the substrate 54 and being fixed on the end of each installation standoff 62 and the end of the fixing standoff 72 respectively, so as to fasten each installation standoff 62 and the fixing standoff 72 on the substrate 54. In this embodiment, each fastening component 74 can be a screw and is screwed on the end of each installation standoff 62 and the end of the fixing standoff 72. The fastening component 74 is not limited to a screw, for example, the fastening component 74 can be a bolt embedded at the end of the installation standoff 62 and the end of the fixing standoff 72 and protruding outside the substrate 54, and the bolt can be screwed with a nut on the other side of the substrate 54, so as to fasten the installation standoff 62 and the fixing standoff 72 on the substrate 54.

Figure 3:
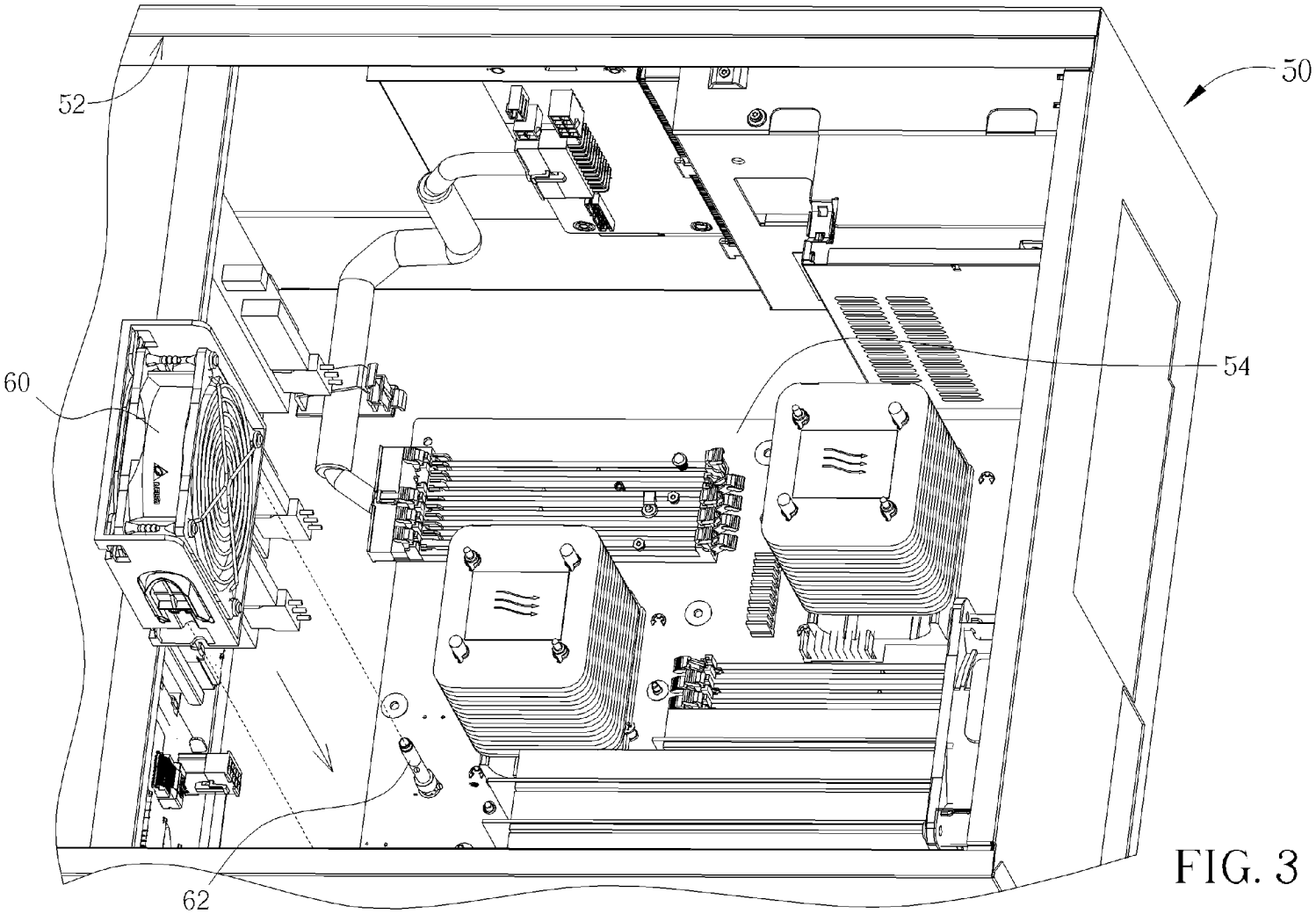
FIG. 3 to FIG. 5 are assembly diagrams of the fan structure on a substrate of the electronic device according to the embodiment of the present invention.
Figure 4:
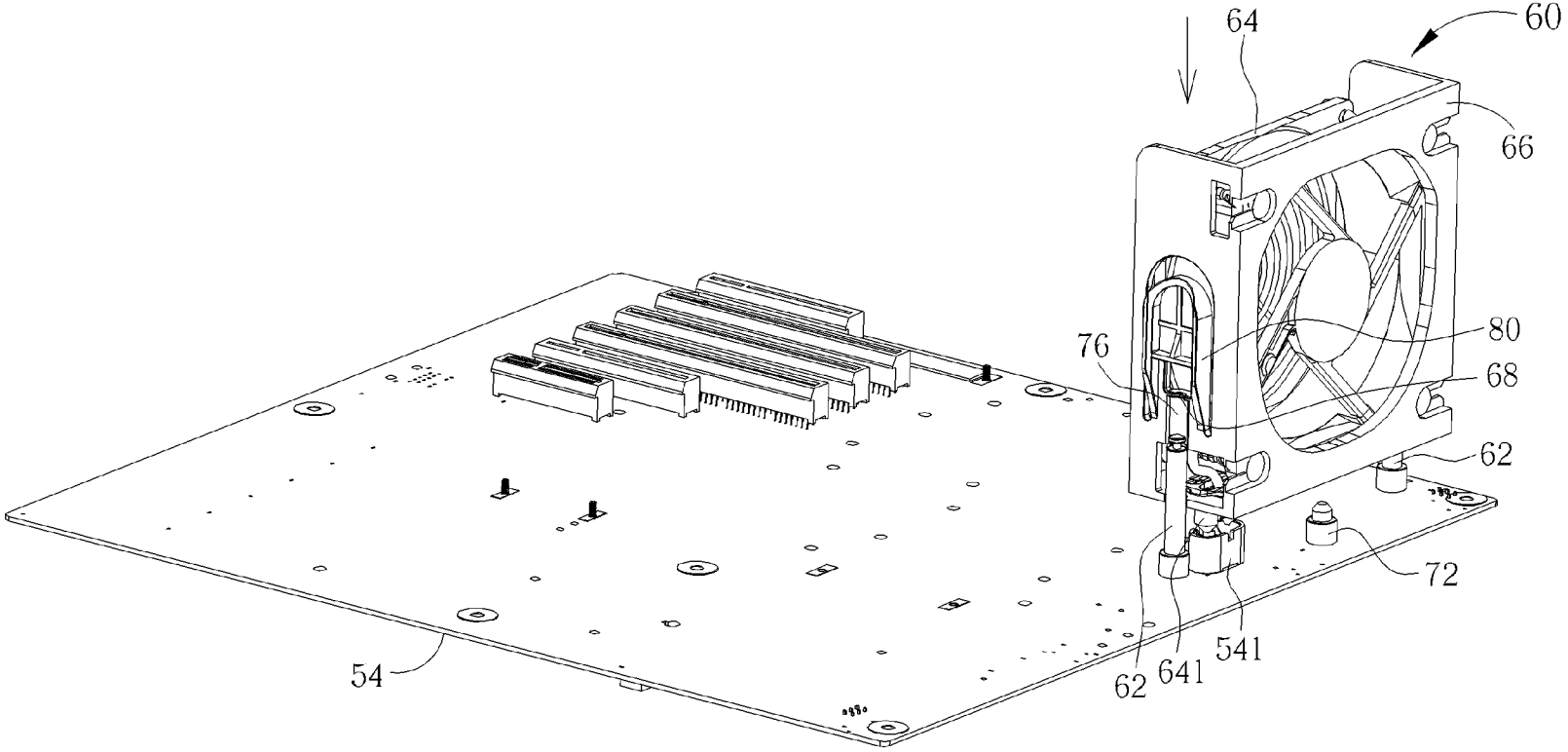
Figure 5:
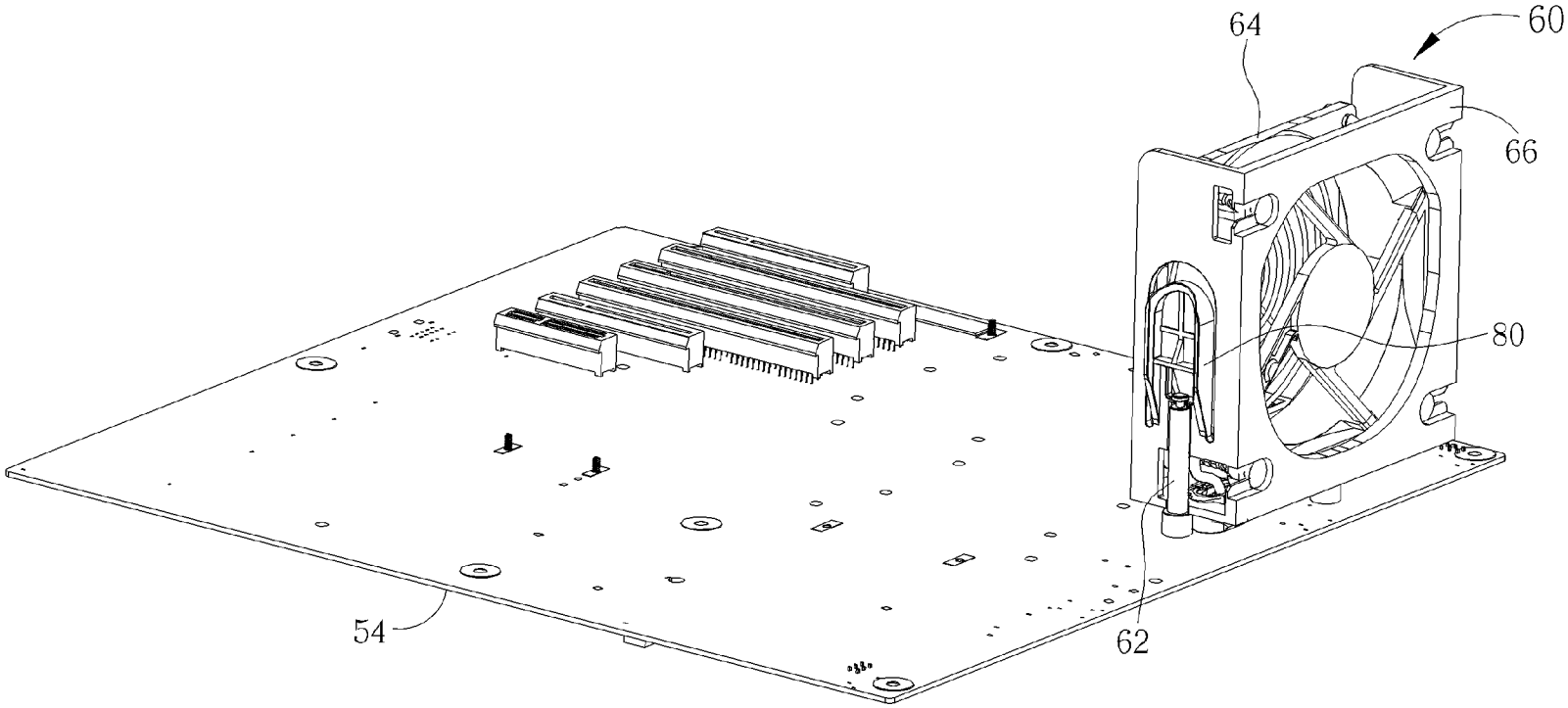
Figure 6:
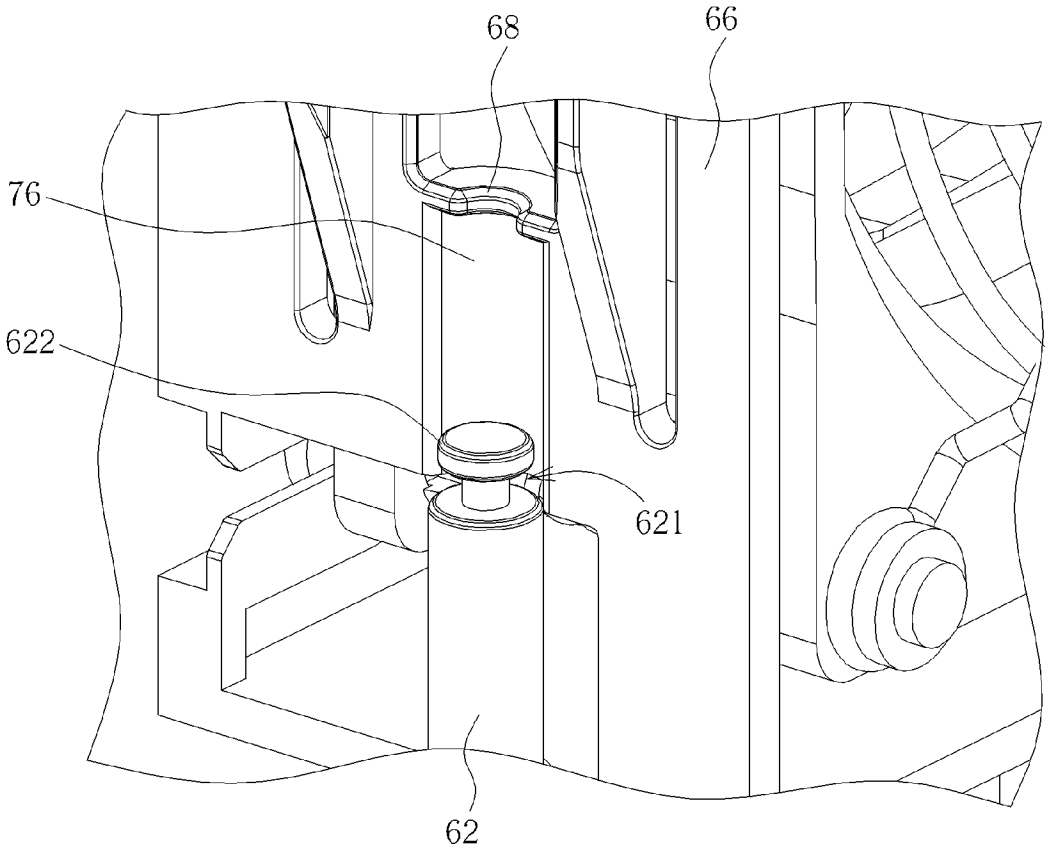
FIG. 6 is an enlarged diagram of FIG. 4 according to the embodiment of the present invention.
Figure 7:
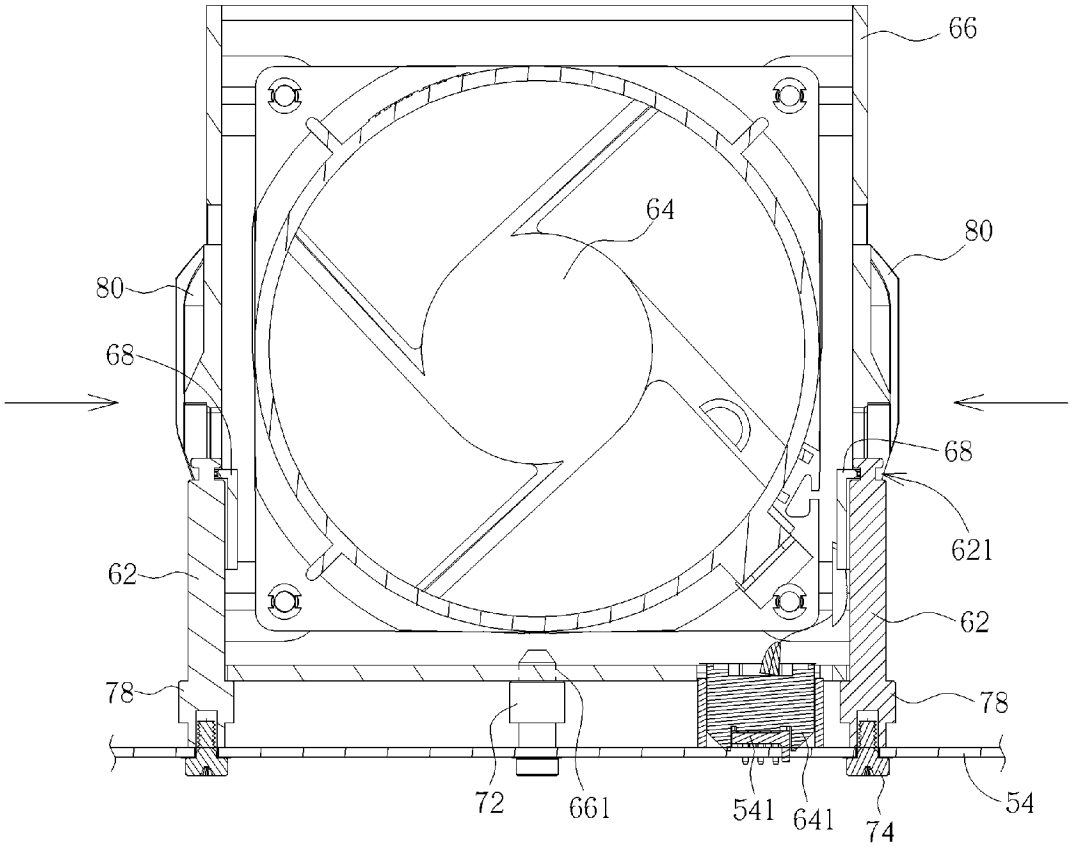
FIG. 7 is a diagram of the fan structure fixed on the substrate according to the embodiment of the present invention.

Please refer to FIG. 3 to FIG. 7. FIG. 3 to FIG. 5 are assembly diagrams of the fan structure 60 on the substrate 54 of the electronic device 50 according to the embodiment of the present invention. FIG. 6 is an enlarged diagram of FIG. 4 according to the embodiment of the present invention. FIG. 7 is a diagram of the fan structure 60 fixed on the substrate 54 according to the embodiment of the present invention. As shown in FIG. 3, when it is desired to install the fan structure 60 inside the electronic device 50, users can grip the two sides of the fixing frame 66 and align the fixing frame 66 with the installation standoffs 62 and the fixing standoff 72 on the substrate 54, and then install the fixing frame 66 in a direction of an arrow illustrated in FIG. 4. As shown in FIG. 4 and FIG. 6, a guiding slot 76 is formed on each side of the fixing frame 66. The guiding slot 76 is for guiding the corresponding installation standoff 62 to move on the fixing frame 66. In addition, a guiding structure 622 is formed on the end of each installation standoff 62. The guiding structure 622 is for guiding the positioning slot 621 of the installation standoff 62 to engage with the corresponding positioning hook 68. Therefore, in the procedure of installation, the installation standoff 62 can move to the positioning hook 68 along the guiding slot 76. Then as the guiding structure 622 of the end of the installation standoff 62 contacts the positioning hook 68, the guiding structure 622 guides the positioning slot 621 to engage with the positioning hook 68, so that the fixing frame 66 is easily installed on the substrate 54 as shown in FIG. 5.

Please refer to FIG. 4 and FIG. 7. A connector socket 541 corresponding to the connector 641 of the fan 64 is disposed on the substrate 54. When the fixing frame 66 is engaged with the at least one installation standoff 62, the connector 641 is plugged into the connector socket 541. That is, the fan 64 is electrically connected to the substrate 54 while the fixing frame 66 is fixed on the substrate 54. As shown in FIG. 7, when the fixing frame 66 is engaged with the installation standoffs 62, the fixing standoff 72 on the substrate 54 is also plugged into a hole 661 of the fixing frame 66, so that the fixing frame 66 is installed on the substrate 54 more stably. As shown in FIG. 5, after the fixing frame 66 is engaged with the installation standoffs 62 and the connector 641 and the fixing standoff 72 are plugged into the connector socket 541 and the hole 661 respectively, the fan structure 60 is installed on the substrate 54. In this embodiment, the fan structure 60 of the present invention is standing to install on the substrate 54. The fan structure 60 in a standing way can save an occupied space on the substrate 54, so that there is an enough space to dispose other electronic components for layout configuration. However, if it is desired to install the fan structure 60 in a lying way, it only needs to change disposal of the positioning hook 68 and the guiding slot 76, such as rotating the positioning hook 68 and the guiding slot 76 by 90 degrees, and to adjust a height of the installation standoff 62 to fit a height of the lying fan structure 60, so that the fan structure 60 can be installed on the substrate 54 in the lying way.

As shown in FIG. 7, it is noticed that a protruding structure 78 is formed on the end of the installation standoff 62, and the protruding structure 78 is for contacting against the fixing frame 66 as the fixing frame 66 is engaged with the installation standoff 62, so as to locate the fan 64 relative to the substrate 54 at a predetermined height. That is, it can adjust a height of the fan 64 relative to the substrate 54 by locating the protruding structure 78. For example, an air outlet of the fan 64 can aim at heat sources by adjusting the height of the fan 64 to increase heat dissipation efficiency. In this embodiment, the protruding structure 78 and the installation standoff 62 can be integrally formed, but are not limited to the integration. For example, the protruding structure 78 can be a rotatable ring sheathing the installation standoff 62, so that users can rotate the protruding structure 78 to adjust a height of the protruding structure 78. Furthermore, the protruding structure 78 can be designed not to extend to a bottom of the installation standoff 62. That is, an outer diameter of the end of the installation standoff 62 close to the substrate 54 can be designed to be less than an outer diameter of the protruding structure 78, for reserving more mechanical space near the substrate 54 and the bottom of the installation standoff 62 to dispose more small electronic components, such as resistors, capacitances and so on.

Please refer to FIG. 5 and FIG. 7, the fixing frame 66 includes at least one resilient portion 80 connected to each positioning hook 68. Each resilient portion 80 drives the corresponding positioning hook 68 to separate from the corresponding positioning slot 621 as being pressed to move inwardly in a direction of an arrow as shown in FIG. 7. In this embodiment, the fixing frame 66 can include two resilient portions 80. The two resilient portions 80 and the two positioning hooks 68 can be integrally formed, and the two resilient portions 80 are disposed on the two sides of the fixing frame 66 respectively. Positions and amounts of the resilient portions 80 are not limited to this embodiment, and it depends on actual design demand. When users desire to detach the fan structure 60 from the substrate 54, users only need to press the resilient portions 80 on the two sides of the fixing frame 66 inwardly, so as to drive the positioning hooks 68 connected to the resilient portions 80 to detach from the positioning slots 621 of the installation standoffs 62, and then pull the fixing frame 66 away from the substrate 54 and detach the connector 641 from the connector socket 541. As a result, the fixing frame 66 and the fan 64 are detached from the electronic device 50.

In contrast to the prior art, the fan structure of the present invention utilizes a fixing mechanism of the installation standoffs installed on the substrate and the positioning hooks of the fixing frame on the fan to easily engage the fixing frame with the installation standoffs, so as to achieve a purpose of fixing the fan on the substrate stably without any screw. In addition, users only need to press the resilient portion to detach the positioning hook from the installation standoff to achieve a purpose of easily detaching the fan from the substrate. Therefore, the present invention solves the problem that the installation space of the electronic device is too small to install the fan in the prior art.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A fan structure, comprising:

at least one installation standoff, an end of the at least one installation standoff being installed on a substrate, and a positioning slot being formed on the other end of the at least one installation standoff;

a fan; and a fixing frame installed on the fan, and the fixing frame comprising at least one positioning hook for engaging with the positioning slot of the at least one installation standoff, so as to fix the fixing frame on the substrate, wherein a guiding slot is formed on at least one side of the fixing frame for guiding the at least one installation standoff to move on the fixing frame.

2. The fan structure of claim 1, further comprising a fixing standoff, an end of the fixing standoff being installed on the substrate, and the other end of the fixing standoff being plugged into a hole of the fixing frame, so as to fix the fixing frame on the substrate with the at least one installation standoff cooperatively.

3. The fan structure of claim 2, further comprising a plurality of fastening components passing through the substrate and being fixed on the end of the at least one installation standoff and the end of the fixing standoff respectively, so as to fasten the at least one installation standoff and the fixing standoff on the substrate.

4. The fan structure of claim 3, wherein each fastening component is a screw.

5. The fan structure of claim 1, wherein the fixing frame further comprises at least one resilient portion connected to the at least one positioning hook, and the at least one resilient portion drives the at least one positioning hook to separate from the at least one positioning slot as being pressed to move inwardly.

6. The fan structure of claim 1, wherein a guiding structure is formed on the end of the at least one installation standoff, and the guiding structure is for guiding the positioning slot of the at least one installation standoff to engage with the at least one positioning hook.

7. The fan structure of claim 1, wherein the fan comprises a connector, a connector socket corresponding to the connector is disposed on the substrate, and the connector is plugged into the connector socket simultaneously as the fixing frame is engaged with the at least one installation standoff.

8. The fan structure of claim 1, wherein a protruding structure is formed on the end of the at least one installation standoff, and the protruding structure is for contacting against the fixing frame as the fixing frame is engaged with the at least one installation standoff, so as to locate the fan relative to the substrate at a predetermined height.

9. The fan structure of claim 1, further comprising at least one shock-absorbing component for fixing the fixing frame on the fan and further for absorbing relative vibration between the fixing frame and the fan.

10. An electronic device, comprising:

a casing;

a substrate installed inside the casing; and a fan structure, comprising:

at least one installation standoff, an end of the at least one installation standoff being installed on the substrate, and a positioning slot being formed on the other end of the at least one installation standoff;

a fan; and a fixing frame installed on the fan, and the fixing frame comprising at least one positioning hook for engaging with the positioning slot of the at least one installation standoff, so as to fix the fixing frame on the substrate, wherein a guiding slot is formed on at least one side of the fixing frame for guiding the at least one installation standoff to move on the fixing frame.

11. The electronic device of claim 10, further comprising a fixing standoff, an end of the fixing standoff being installed on the substrate, and the other end of the fixing standoff being plugged into a hole of the fixing frame, so as to fix the fixing frame on the substrate with the at least one installation standoff cooperatively.

12. The electronic device of claim 11, further comprising a plurality of fastening components passing through the substrate and being fixed on the end of the at least one installation standoff and the end of the fixing standoff respectively, so as to fasten the at least one installation standoff and the fixing standoff on the substrate.

13. The electronic device of claim 12, wherein each fastening components is a screw respectively.

14. The electronic device of claim 10, wherein the fixing frame further comprises at least one resilient portion connected to the at least one positioning hook, and the at least one resilient portion drives the at least one positioning hook to separate from the at least one positioning slot as being pressed to move inwardly.

15. The electronic device of claim 10, wherein a guiding structure is formed on the end of the at least one installation standoff, and the guiding structure is for guiding the positioning slot of the at least one installation standoff to engage with the at least one positioning hook.

16. The electronic device of claim 10, wherein the fan comprises a connector, a connector socket corresponding to the connector is disposed on the substrate, and the connector is plugged into the connector socket simultaneously as the fixing frame is engaged with the at least one installation standoff.

17. The electronic device of claim 10, wherein a protruding structure is formed on the end of the at least one installation standoff, and the protruding structure is for contacting against the fixing frame as the fixing frame is engaged with the at least one installation standoff, so as to locate the fan relative to the substrate at a predetermined height.

18. The electronic device of claim 10, further comprising at least one shock-absorbing component for fixing the fixing frame on the fan and further for absorbing relative vibration between the fixing frame and the fan.

* * * * *